US006540388B2

(12) United States Patent
Aida et al.

(10) Patent No.: US 6,540,388 B2
(45) Date of Patent: Apr. 1, 2003

(54) MOUNTING STRUCTURE FOR A DISCHARGE LAMP LIGHTING DEVICE

(75) Inventors: Kenji Aida, Kariya (JP); Hiroaki Okuchi, Southfield, MI (US); Masamichi Ishikawa, Hekinan (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/784,323

(22) Filed: Feb. 16, 2001

(65) Prior Publication Data

US 2001/0015897 A1 Aug. 23, 2001

(30) Foreign Application Priority Data

Feb. 17, 2000 (JP) ..... 2000-045144
Apr. 7, 2000 (JP) ..... 2000-106993
Jan. 24, 2001 (JP) ..... 2001-016048

(51) Int. Cl.[7] ..... H01J 5/48

(52) U.S. Cl. ..... 362/548; 362/507; 362/549; 313/318.12

(58) Field of Search ..... 362/507, 548, 362/549; 313/318.12

(56) References Cited

U.S. PATENT DOCUMENTS 5,118,990 A * 6/1992 Makita ..... 315/291
5,119,275 A * 6/1992 Makita ..... 362/459
5,597,232 A * 1/1997 Ohashi et al. ..... 362/265
5,659,221 A * 8/1997 Coushaine et al. .... 313/318.01
5,722,768 A * 3/1998 Suzuki et al. ..... 362/226
5,795,056 A * 8/1998 Seiger ..... 362/226
5,814,927 A * 9/1998 Chen ..... 313/318.01
6,364,515 B1 * 4/2002 Daub et al. ..... 362/226

FOREIGN PATENT DOCUMENTS

FR 2 704 937 11/1994
FR 2 704 938 11/1994
JP 10-228804 8/1998

* cited by examiner

*Primary Examiner*—Sandra O'Shea
*Assistant Examiner*—Ismael Negron
(74) *Attorney, Agent, or Firm*—Nixon & Vanderhye P.C.

(57) ABSTRACT

A mounting structure for mounting a discharge lamp lighting device is arranged to directly connect a discharge lamp provided in a headlight unit to a connector provided in the discharge lamp lighting device. The headlight unit includes a reflector, and the mounting structure comprises a holder for holding the discharge lamp, wherein the holder includes a holder securing portion directly connected to the reflector and is secured to the reflector via the holder securing portion. The discharge lamp is secured to the reflector via the holder. The mounting structure further comprises a securing member directly connected to the reflector for securing the discharge lamp lighting device to the reflector. The holder and the securing member are separated from each other and the discharge lamp lighting device is secured to the reflector via the securing member.

21 Claims, 6 Drawing Sheets

MOUNTING STRUCTURE FOR A DISCHARGE LAMP LIGHTING DEVICE

CROSS REFERENCE TO RELATED APPLICATION

This application is based on and incorporates herein by reference Japanese patent applications No. 2000-45144 filed Feb. 17, 2000, No. 2000-106993 filed Apr. 7, 2000, and No. 2001-16048, filed Jan. 24, 2001.

BACKGROUND OF THE INVENTION

The present invention relates to a discharge lamp lighting device that lights up a high voltage discharge lamp used in a vehicle headlight unit or the like. The present invention further relates to a mounting structure for mounting the discharge lamp lighting device onto the vehicle headlight unit or the like.

A discharge lamp lighting device has been used in a vehicle headlight unit. For instance, the discharge lamp lighting device can be mounted outside or inside of the headlight unit. In the case of mounting the discharge lamp lighting device outside of the headlight unit, the discharge lamp is connected to the discharge lamp lighting device via an output electric line extending out from the discharge lamp lighting device and also via a connector that is connected to the output electric line. In the case of mounting the discharge lamp lighting device inside of the headlight unit, the discharge lamp is connected to the discharge lamp lighting device also via the output electric line extending out from the discharge lamp lighting device and via the connector.

However, in both cases, the electric line extending out from the discharge lamp lighting device is required to connect the discharge lamp to the discharge lamp lighting device, and thus a size of the entire device can not be reduced.

To overcome these disadvantages, it has been proposed to accommodate the connector in the discharge lamp lighting device and directly connect the discharge lamp to the connector.

In this case, if the discharge lamp lighting device is mounted near the discharge lamp, the discharge lamp lighting device receives heat conducted or radiated from the discharge lamp. Thus, an internal temperature of the discharge lamp lighting device rises, causing excessive thermal stress on elements in the discharge lamp lighting device.

SUMMARY OF THE INVENTION

Thus, it is an objective of the present invention to reduce transmission of heat from a discharge lamp, which is directly connected to a connector accommodated in a discharge lamp lighting device, to the discharge lamp lighting device through heat conduction or heat radiation to reduce thermal stress on the discharge lamp lighting device.

It is another objective of the present invention to reduce transmission of heat to the discharge lamp lighting device from a holder that is provided for securing the discharge lamp to a reflector and that receives heat transmitted from the discharge lamp.

To achieve the objectives of the present invention, in a mounting structure for mounting a discharge lamp lighting device, a holding member for holding a discharge lamp is separated from a securing member for securing the discharge lamp lighting device to a headlight unit or to components in the headlight unit. The holder may have a holder opening for receiving the discharge lamp. Furthermore, the holder may have a holder securing portion for securing the discharge lamp to the headlight unit or to the component in the headlight unit. The holder securing portion can be offset from an area above the holder opening. Also, the securing member can be offset from an area above a connector of the discharge lamp lighting device to which the discharge lamp is connected. In addition, the headlight unit may have a reflector having a plurality of retaining portions. The holder securing portion of the holder and the securing member can be secured to different retaining portions of the reflector.

Furthermore, to achieve the objective of the present invention, a space can be formed between an outer wall surface of the discharge lamp and a connector housing of the connector. Another space can be formed around the connector housing.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE PREFERRED EMBODIMENT (First Embodiment)

A first embodiment of the present invention will be described with reference to FIGS. 1 to 3.

Figure 1:
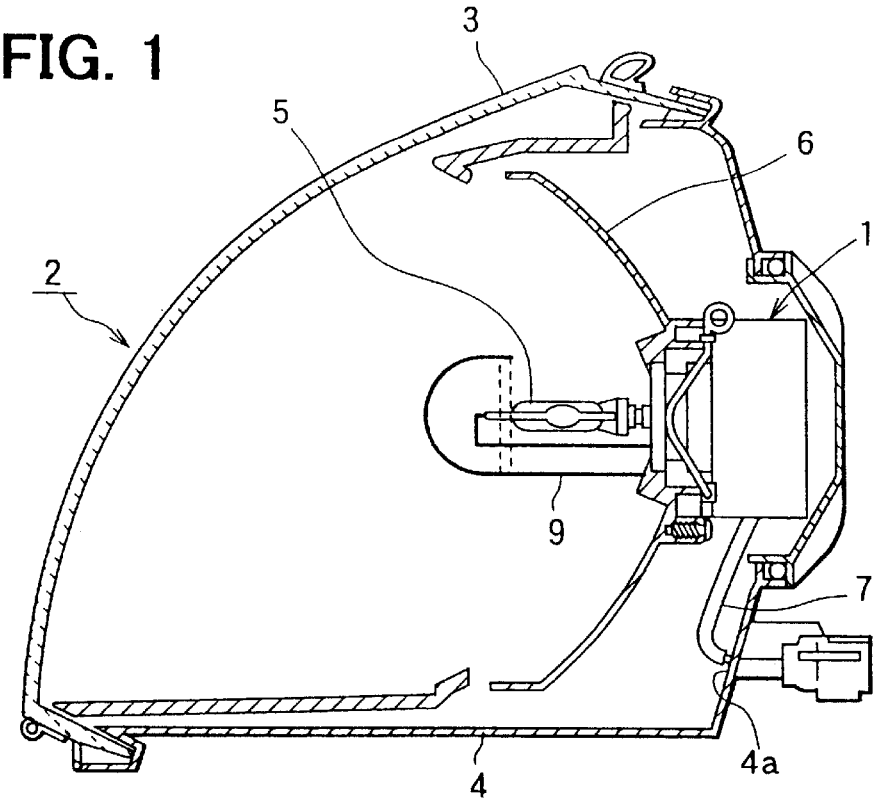
FIG. 1 is a longitudinal cross-sectional view of a headlight unit according to a first embodiment of the present invention.

As shown in FIG. 1, a translucent lens 3 and a housing 4 define an interior of a vehicle headlight unit 2. A high voltage discharge lamp 5 and a reflector 6 are arranged in the interior of the headlight unit 2. The reflector 6 has a reflecting mirror on its front side. The reflecting mirror of the reflector 6 is formed by vapor deposition of aluminum onto a resin reflector body. In this embodiment, a discharge lamp lighting device 1 that lights up the discharge lamp 5 is arranged in the interior of the headlight unit 2 on a rear side of the reflector 6. Electric power is supplied to the lighting device 1 through an electric line 7 that extends from the lighting device 1 to outside of the headlight unit 2 through a through hole 4*a* that penetrates through a rear side of the housing 4.

Figure 2:
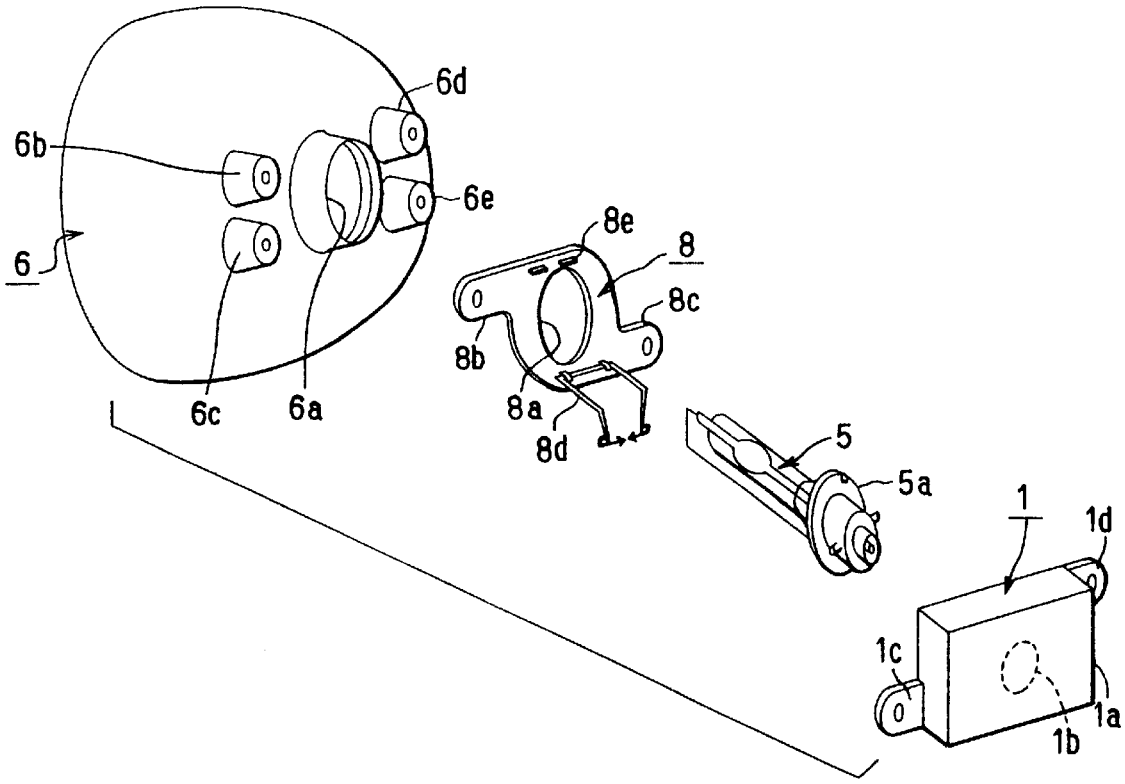
FIG. 2 is an exploded perspective view showing a state prior to assembly of a discharge lamp lighting device according to the first embodiment.

Pre-assembled states of the discharge lamp 5, the reflector 6 and the lighting device 1 are shown in FIG. 2. As shown in FIG. 2, a reflector opening 6*a* for receiving the discharge lamp 5 penetrates through a center of the reflector 6. A plurality of retaining portions 6*b*–6*e* are formed on a rear surface of the reflector 6 at locations offset from an area above the reflector opening 6*a*. In the present embodiment, these retaining portions 6*b*–6*e* are arranged such that two vertically aligned retaining portions 6*b* and 6*c* are arranged on the left side of the reflector opening 6*a*, and other two vertically aligned retaining portions 6*d* and 6*e* are arranged on the right side of the reflector opening 6*a*.

A holder 8 is a member for holding the discharge lamp 5 and securing the discharge lamp 5 to the reflector 6. The holder 8 is made of a metal material and shields noises generated from the discharge lamp 5. A holder opening 8*a* penetrates through a center of the holder 8 for receiving the discharge lamp 5. Securing portions (holder securing portions) 8*b* and 8*c* for securing the holder 8 to the reflector 6 are arranged on the holder 8 at locations offset from an area above the holder opening 8*a*. In this embodiment, these locations are on the left side and the right side of the holder opening 8*a* and in the diagonal relation. The securing portions 8*b* and 8*c* of the holder 8 are aligned with the one diagonal pair (6*b* and 6*e*) of the retaining portions 6*b*–6*e* arranged on the reflector 6. A spring 8*d* for retaining the discharge lamp 5 on the holder 8 is arranged at the bottom side of the holder 8. An engaging portion 8*e* for engaging with distal ends of the spring 8*d* is formed at the top side of the holder 8.

The holder 8 is secured to the reflector 6 by first aligning the securing portions 8*b* and 8*c* of the holder 8 with the corresponding retaining portions 6*b* and 6*e* of the reflector 6 and then securing them together, for example, by screws. Thereafter, the discharge lamp 5 is inserted into the holder opening 8*a* until a flange 5*a* of the discharge lamp 5 abuts the reflector 6. Next, the spring 8*d* is rotated all the way to the engaging portion Be and is elastically deformed in directions of arrows to engage with the engaging portion 8*e*. In this way, the discharge lamp 5 is held by the reflector 6 while being urged in a discharge lamp inserting direction of the holder 8.

The lighting device 1 has internal electronic circuits within a case 1*a*. The internal circuits are for driving the discharge lamp 5. A connector 1*b* for electrically connecting the internal circuits of the lighting device 1 with the discharge lamp 5 is positioned at a center of the case 1*a* of the lighting device 1. Securing portions (securing member) 1*c* and 1*d* are provided on the case 1*a* diagonally, that is, on the left side and the right side of the connector 1*b*, respectively. The securing portions 1*c* and 1*d* constitute a securing member for securing the lighting device 1 to the headlight unit 2 or the component (in this embodiment, reflector 6) in the headlight unit 2. The lighting device 1 is secured to the reflector 6 by securing the securing portions 1*c* and 1*d* of the lighting device 1 to the corresponding retaining portions 6*c* and 6*d* of the reflector 6, for example, by screws. The securing portions 1*c* and 1*d* of the case 1*a* are arranged to align with the other diagonal pair (6*c* and 6*d*) of the retaining portions 6*b*–6*e* of the reflector 6 that are different from the one diagonal pair of the retaining portions 6*b*–6*e* of the reflector 6 to which the securing portions 8*b* and 8*c* of the holder 8 are secured. The securing portions 1*c* and 1*d* of the case 1*a* are arranged right next to the corresponding securing portions 8*c* and 8*b* of the holder 8 in a horizontal direction, respectively.

Figure 3:
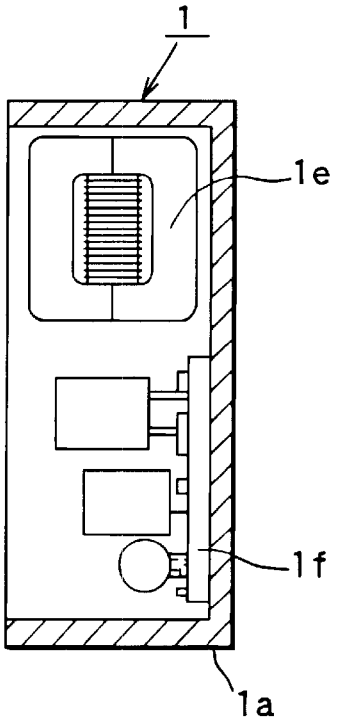
FIG. 3 is a longitudinal cross-sectional view of a discharge lamp lighting device shown in FIGS. 1 and 2.

A longitudinal cross-section of the lighting device 1 is shown in FIG. 3. The internal circuits of the lighting device 1 include heat resistant components 1*e*, such as inductor components (e.g., transformers for increasing a voltage supplied from a vehicle battery), as well as heat sensitive components if, such as a hybrid IC, an electrolytic capacitor or the like. The heat resistant components 1*e* are arranged at the upper side of the lighting device 1, and the heat sensitive components if are arranged at the lower side of the lighting device 1.

With the above-described arrangements, the holder 8 and the discharge lamp 5 are first secured to the reflector 6. Then, the discharge lamp 5 is connected to the connector 1*b* of the lighting device 1. Thereafter, the case 1*a* of the lighting device 1 is secured to the reflector 6. Thus, the discharge lamp 5, the holder 8 and the lighting device 1 are secured to the reflector 6. Then, the reflector 6 is secured to the housing 4 along with the discharge lamp 5, the lighting device 1 and the others. As a result, the lighting device 1 is assembled onto the headlight unit 2.

In the above structure, the heat conducted from the rear surface of the heated discharge lamp 5 or the radiant heat of the discharge lamp 5 is transmitted to the lighting device 1 through the following path.

First, since the discharge lamp 5 is in contact with or in proximity to the holder 8, the heat from the rear surface of the heated discharge lamp 5 is conducted to the holder 8. Thereafter, the heat is transmitted to the reflector 6 via a thermal path between the holder 8 and the reflector 6 and is then transmitted to the lighting device 1. On the other hand, the radiant heat is conducted to the lighting device 1 through two paths, i.e., directly from the reflector 6 to the lighting device 1 and indirectly from the reflector 6 to the lighting device 1 via the holder 8.

As a result, not all of the heat is directly conducted to the lighting device 1 from the discharge lamp 5, and not all of the radiant heat is transmitted to the lighting device 1 directly from the reflector 6.

As discussed above, the holder 8 is provided as the member for holding the discharge lamp 5. Furthermore, the holder 8 is separated from the members 1*c* and 1*d* for securing the lighting device 1 to the headlight unit 2 or to the components in the headlight unit 2. Thus, the thermal stress on the lighting device 1 induced by the heat transmitted from the rear surface of the discharge lamp 5 or the radiant heat is reduced. As a result, the discharge lamp lighting device 1 can avoid the damage induced by the thermal stress. Especially, in the case where the reflector 6 is made of a resin material, the resin material is positioned in the thermal path between the holder 8 and the lighting device 1, so that the heat conduction between them is more effectively reduced.

A temperature at the upper side of the headlight unit 2 gets especially high due to the thermal convection within the headlight unit 2. The lower side of the discharge lamp 5 or the reflector 6 is covered with a shade 9 to prevent glare to an oncoming vehicle. Thus, the light is mainly reflected from the upper side of the reflector 6. This arrangement also contributes to the development of the high temperature at the upper side of the headlight unit 2. Therefore, it is preferable to locate the heat resistant components 1*e* at an elevated position and locate heat sensitive components If underside the heat resistant components 1*e* thereby protecting the heat sensitive components le from heat.

In the present embodiment, the retaining portions 6*b*–6*e* of the reflector 6, the securing portions 8*b*–8*c* of the holder 8 and the securing portions 1*c* and 1*d* of the case 1*a* are arranged on the left side and the right side of the discharge lamp 5. The holder 8 and the lighting device 1 are secured to the reflector 6 at the position apart from the upper side of the headlight unit 2 where the temperature normally gets very high. With this arrangement, the thermal conduction from the upper side of the headlight unit 2 where the temperature gets very high is reduced. Thus, the thermal stress on the lighting device can be advantageously reduced.

(Second Embodiment)

Figure 4:
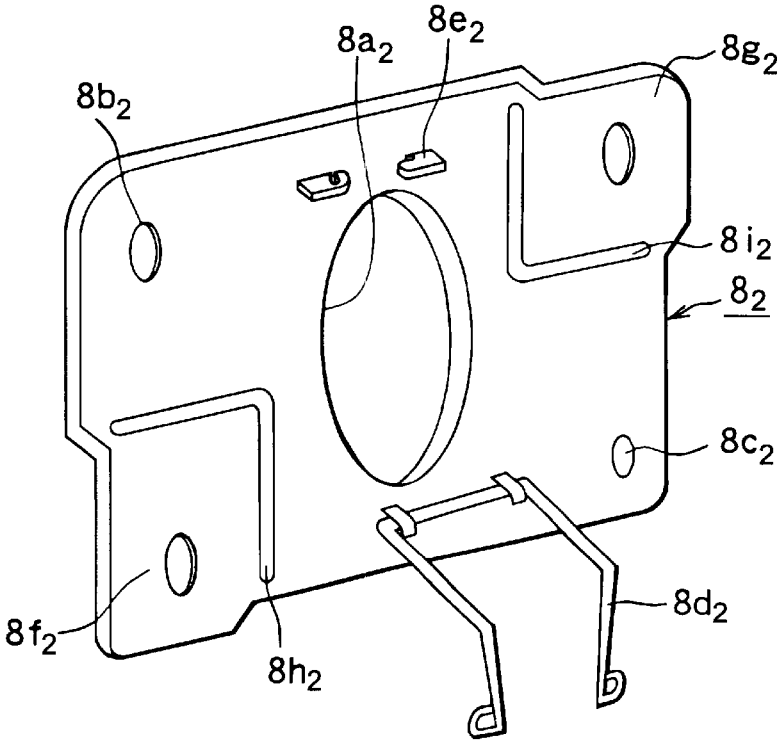
FIG. 4 is an enlarged perspective view of a holder according to a second embodiment of the present invention.

In a second embodiment shown in FIG. 4, the shape of the holder 8 shown in FIG. 2 is modified, and the rest of the structure is the same as that of the first embodiment.

As shown in FIG. 4, the holder $\mathbf{8}_2$ of the present embodiment has four securing portions $\mathbf{8}b_2$, $\mathbf{8}c_2$, $\mathbf{8}f_2$ and $\mathbf{8}g_2$ to be secured to the retaining portions 6*b*–6*e* of the reflector 6. An angled slit $\mathbf{8}h_2$ is formed between the securing portion $\mathbf{8}f_2$, which is aligned with the securing portion 1*c* of the case 1*a*, and the holder opening $\mathbf{8}a_2$. Another slit $\mathbf{8}i_2$ is formed between the securing portion $\mathbf{8}g_2$, which is aligned with the securing portion 1*b* of the case 1*a*, and the holder opening $\mathbf{8}a_2$. Furthermore, the holder 82 is deformed at each of the slits $\mathbf{8}h_2$ and $\mathbf{8}i_2$ to form a protruded portion protruding toward the lighting device 1 from the rest of the holder $\mathbf{8}_2$. This arrangement provides a space between the holder $\mathbf{8}_2$ and the lighting device 1.

With this structure, the lighting device 1 is secured to the reflector 6 via the holder $\mathbf{8}_2$. Thus, the heat transmitted from the rear surface of the discharge lamp 5 is conducted to the lighting device 1 through the holder $\mathbf{8}_2$.

However, the heat transmitted from the rear surface of the discharge lamp 5 can be partially blocked by the slits $\mathbf{8}h_2$ and $\mathbf{8}i_2$ formed on the holder $\mathbf{8}_2$. Thus, the amount of the heat transmitted to the lighting device 1 can be advantageously reduced. Furthermore, the radiant heat is conducted from the reflector 6 to the lighting device 1 through the holder $\mathbf{8}_2$. Thus, the amount of the radiant heat transmitted to the lighting device 1 is reduced through the holder $\mathbf{8}_2$.

As described above, the thermal stress on the lighting device 1 can be further reduced by forming the slits $\mathbf{8}h_2$ and $\mathbf{8}i_2$ at the securing portions of the holder $\mathbf{8}_2$ which contact the case 1*a*. As a result, advantages similar to those of the first embodiment can be achieved.

(Third Embodiment)

Figure 5:
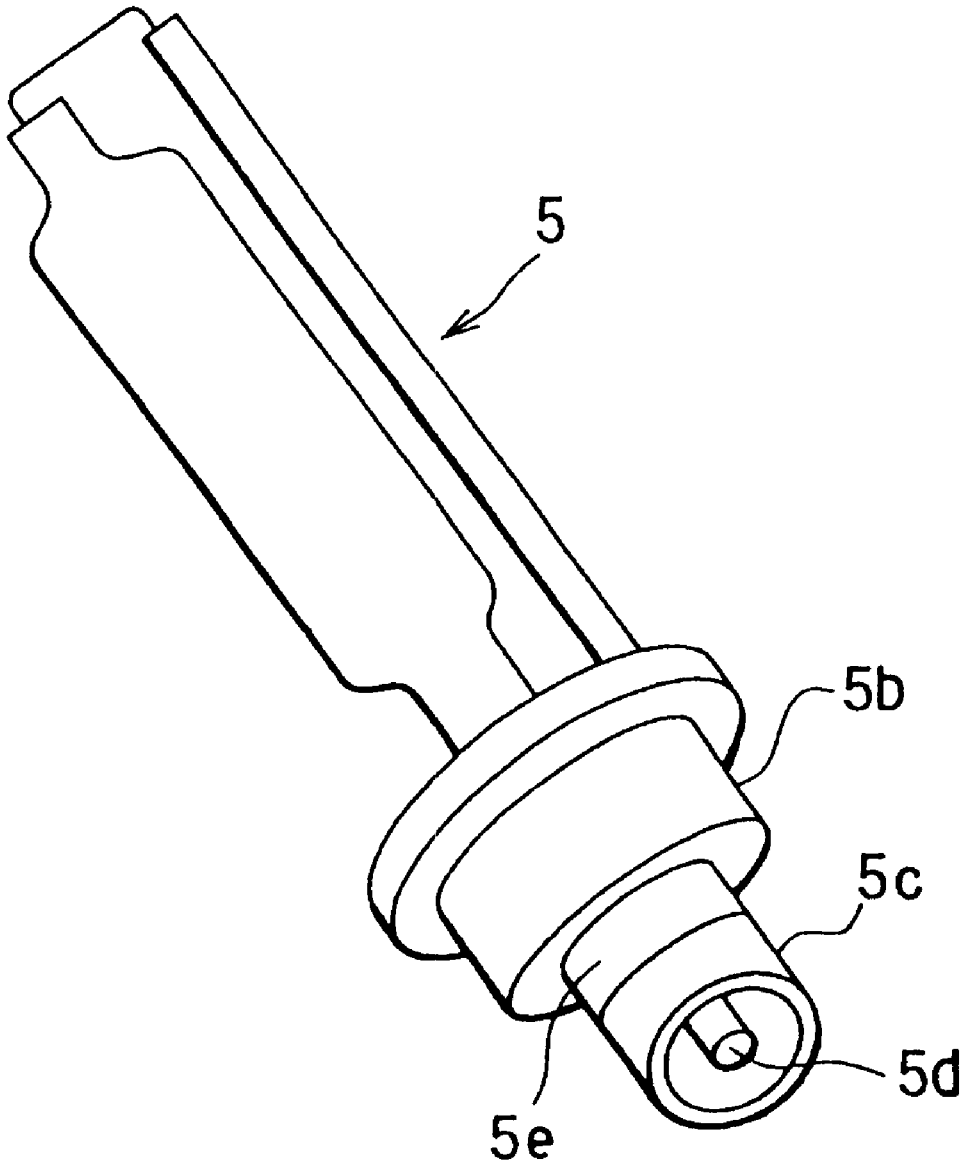
FIG. 5 is an enlarged perspective view of a discharge lamp shown in FIGS. 1 and 2.

In a third embodiment of the present invention, the discharge lamp 5 is connected to the lighting device 1 via a connector portion 5*b* shown in FIG. 5. The connector portion 5*b* has a cylindrical portion 5*c*. Inside of the cylindrical portion 5*c*, there is provided a positive terminal 5*d*. A negative terminal 5*e* is placed on an outer peripheral surface of the cylindrical portion 5*c*.

Figure 6A:
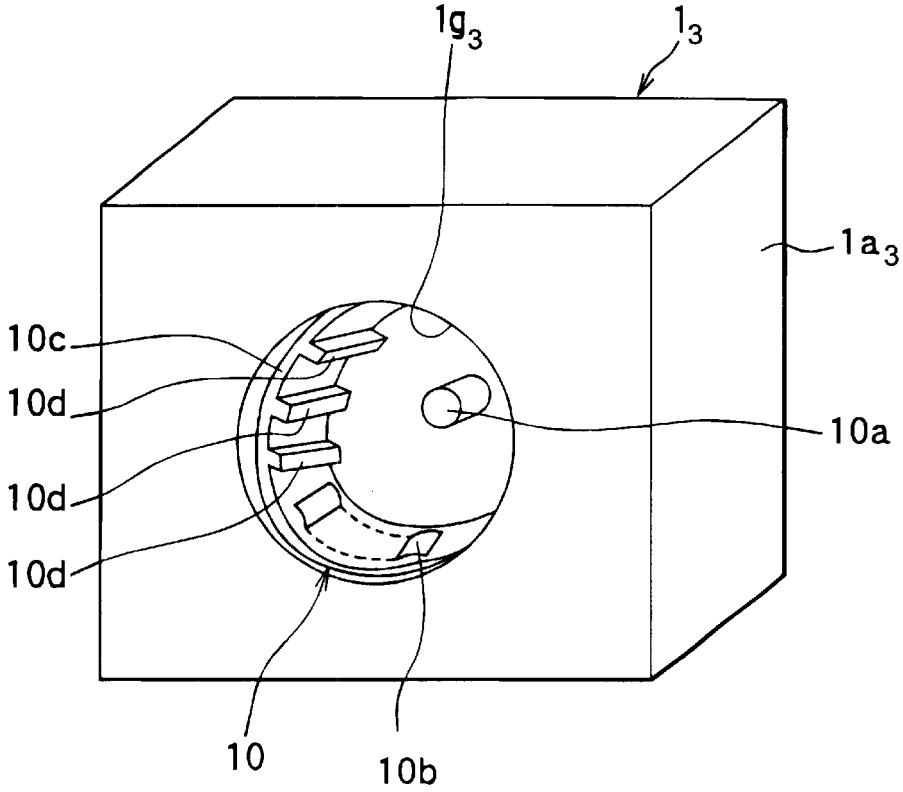
FIG. 6A is a perspective view of the discharge lamp lighting device according to a third embodiment of the present invention.
Figure 6B:
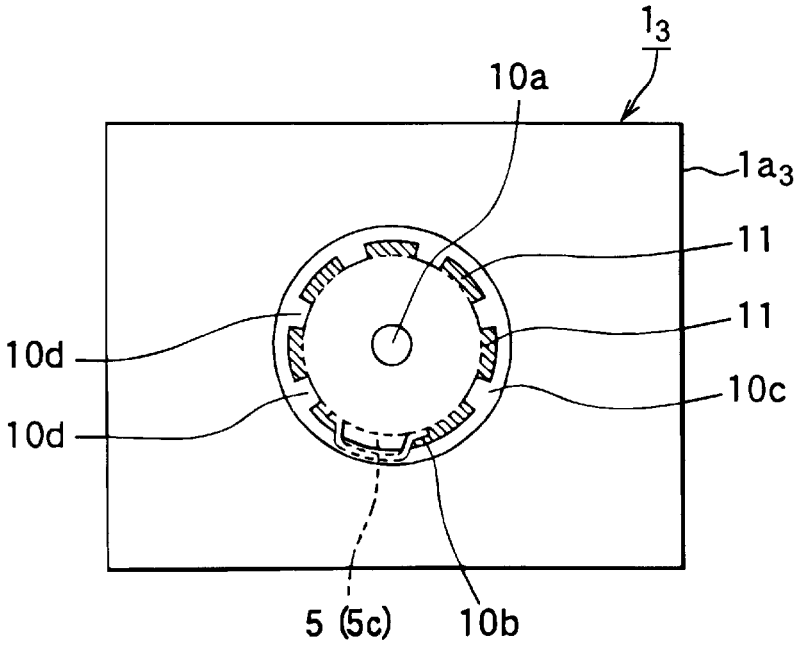
FIG. 6B is a front view of the discharge lamp lighting device shown in FIG. 6A.

As shown in FIGS. 6A and 6B, in a center of the case $\mathbf{1}a_3$ of the lighting device $\mathbf{1}_3$, there is provided a generally cylindrical window $\mathbf{1}g_3$ communicating between the inside and the outside of the case $\mathbf{1}a_3$. The case $\mathbf{1}a_3$ includes a connector 10 similar to the connector 1*b* of the first and second embodiments. The discharge lamp 5 can be connected to the connector 10 through the window 1*g*.

The connector 10 has a positive terminal 10*a*, a negative terminal 10*b* and a connector housing 10*c*.

The connector housing 10*c* has a cup-like shape provided with an opening for inserting the discharge lamp 5. The positive terminal 10*a* is positioned in a center of a bottom wall surface of the connector housing 10*c*. The negative terminal 10*b* is arranged on part of an inner peripheral wall of the connector housing 10*c*.

With reference to FIGS. 6A and 6B, a plurality of protrusions 10*d* are formed on the inner peripheral wall surface of the connector housing 10*c* to protrude from the inner peripheral wall surface of the connector housing 10*c*. These protrusions 10*d* are arranged at generally equal intervals along the inner peripheral wall surface of the connector housing 10*c* and radially inwardly extend toward a center axis of the connector housing 10*c*. The protrusions 10*d* allows formation of spaces (first spaces) 11 between the inner peripheral wall surface of the connector housing 10*c* and the discharge lamp 5 as indicated by the shading lines in FIG. 6B. An outer contour of the discharge lamp 5 is indicated with a dotted line in FIG. 6B.

When the connector portion 5*b* of the discharge lamp 5 is inserted into the connector housing 10*c* of the lighting device 1 constructed as above, the positive terminal 5*d* of the discharge lamp 5 is connected to the positive terminal 10*a* of the connector 10, and the negative terminal 5*e* of the discharge lamp 5 is connected to the negative terminal 10*b* of the connector 10. Thus, the discharge lamp 5 is connected to the lighting device 1.

In the lighting device 1 constructed as above, the spaces 11 formed with the aid of the protrusions 10*d* between the discharge lamp 5 and the inner peripheral wall surface of the connector housing 10*c* provide heat insulation. Thus, the heat generated from the heated discharge lamp 5 is not easily conducted to the connector housing 10*c*. As a result, not all of the heat generated from the discharge lamp 5 is directly transmitted to the discharge lamp lighting device 1.

As described above, due to the spaces 11 formed between the connector housing 10*c* and the discharge lamp 5, the thermal stress on the lighting device 1 is advantageously reduced. Thus, the lighting device 1 can avoid the damage induced by the thermal stress.

(Fourth Embodiment)

Figure 7A:
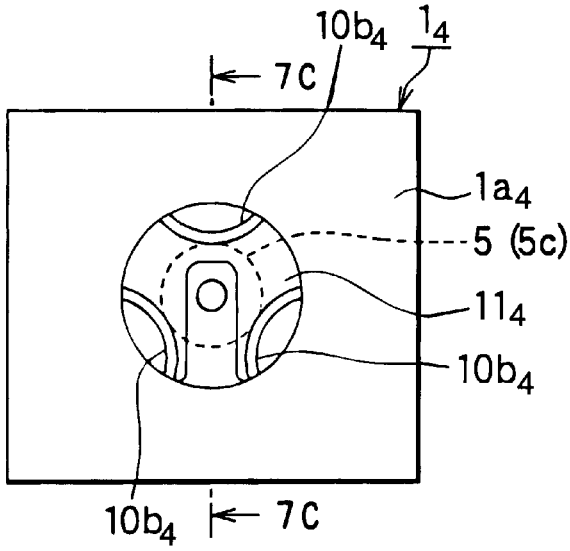
FIG. 7A is a front view of the discharge lamp lighting device according to a fourth embodiment of the present invention.
Figure 7B:
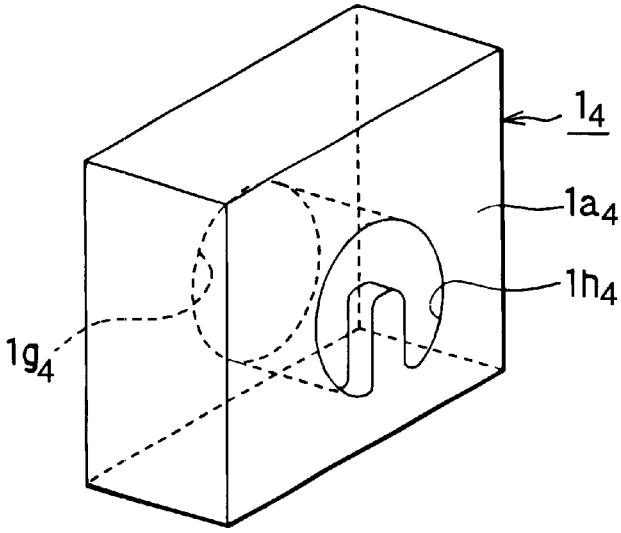
FIG. 7B is a perspective view of the lighting device shown in FIG. 7A.
Figure 7C:
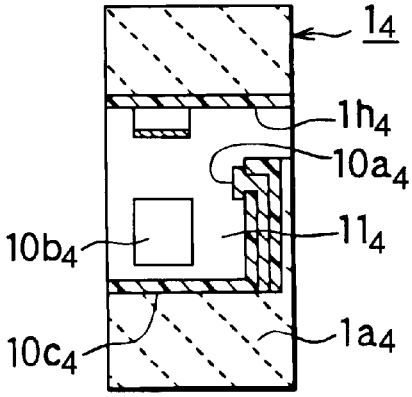
FIG. 7C is a cross-sectional view along line 7C—7C in FIG. 7A.

A fourth embodiment according to the present invention is shown in FIGS. 7A to 7C. A dotted line shown in FIG. 7A indicates an outer counter of the discharge lamp 5 (cylindrical portion 5*c*) connected to the lighting device 14. In FIG. 7C, various internal circuits received in the case $\mathbf{1}a_4$ are not illustrated for brevity. This embodiment is a modification of the connector 10 of the lighting device $\mathbf{1}_3$ of the third embodiment.

As shown in FIG. 7A, the connector 10 of the lighting device $\mathbf{1}_4$ has the connector housing $\mathbf{10}c_4$. In the connector housing $\mathbf{10}c_4$, a plurality of negative terminals (three in this embodiment) $\mathbf{10}b_4$ are arranged to protrude from the inner peripheral wall surface of the connector housing $\mathbf{10}c_4$. These negative terminals $\mathbf{10}b_4$ are arranged at generally equal intervals along the inner peripheral wall surface of the connector housing $\mathbf{10}c_4$ and radially inwardly extend toward the center axis of the connector housing $\mathbf{10}c_4$. The negative terminals $\mathbf{10}b_4$ allow formation of spaces $\mathbf{11}_4$ between the inner peripheral wall surface of the connector housing $\mathbf{10}c_4$ and the discharge lamp 5.

In the lighting device $\mathbf{1}_4$ constructed in the manner described above, the spaces $\mathbf{11}_4$ formed with the aid of the negative terminals $\mathbf{10}b_4$ between the discharge lamp 5 and the inner peripheral wall surface of the connector housing $\mathbf{10}c_4$ provide heat insulation. Thus, the heat from the rear surface of the heated discharge lamp 5 is not easily conducted to the connector housing $\mathbf{10}c_4$. As a result, the advantages similar to those described with reference to the third embodiment can be achieved.

Furthermore, in the present embodiment, an aperture $\mathbf{1}h_4$ is formed in the case $\mathbf{1}a_4$ of the lighting device $\mathbf{1}_4$ in an area where the rear surface of the discharge lamp 5 is placed. Thus, the transmission of the heat from the rear surface of the discharge lamp 5 to the lighting device $\mathbf{1}_4$, i.e., the transmission of the heat to the internal circuits in the case $\mathbf{1}a_4$ through the case $\mathbf{1}a_4$ can be prevented. In this way, the thermal stress on the lighting device $\mathbf{1}_4$ is advantageously reduced. Thus, there is provided the lighting device $\mathbf{1}_4$ that can more effectively avoid the damage induced by the thermal stress.

In the third embodiment, the aperture $\mathbf{1}h_4$ is not formed in the case $\mathbf{1}a_3$ in an area where the rear surface of the discharge lamp 5 is placed. However, by providing such an aperture $\mathbf{1}h_4$ in the case $\mathbf{1}a_3$ of the third embodiment, the advantages similar to those discussed with reference to the fourth embodiment can be achieved.

(Fifth Embodiment)

A fifth embodiment of the present invention is a modification of the third and fourth embodiments, in which the spaces 11 are provided between the inner peripheral wall surface of the connector housing 10*c* (or $\mathbf{10}c_4$) and the outer peripheral surface of the discharge lamp 5 to provide the heat insulation. However, in the fifth embodiment, the heat insulation is provided in a manner that differs from those of the third and fourth embodiments.

Figure 8A:
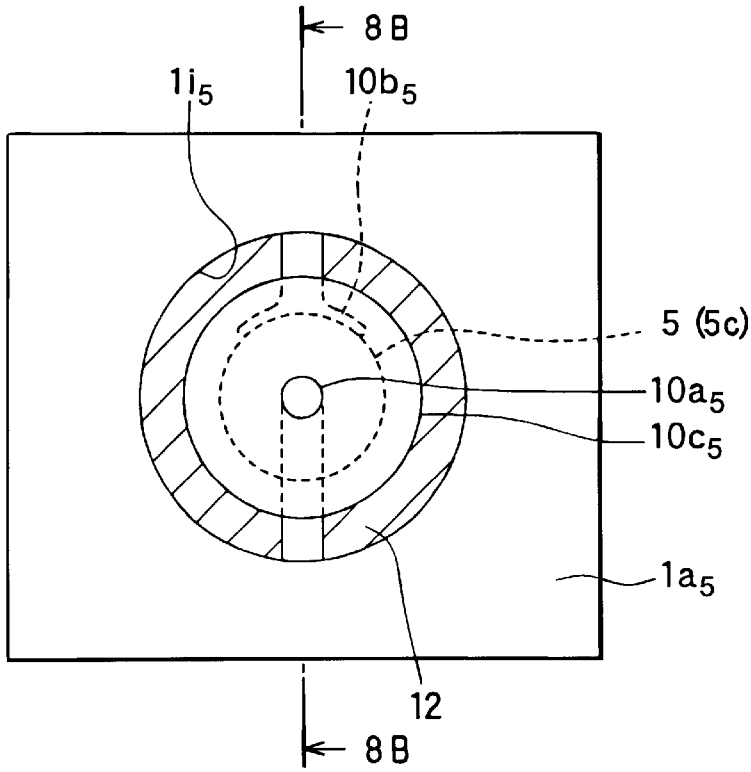
FIG. 8A is a front view of the discharge lamp lighting device according to a fifth embodiment of the present invention.
Figure 8B:
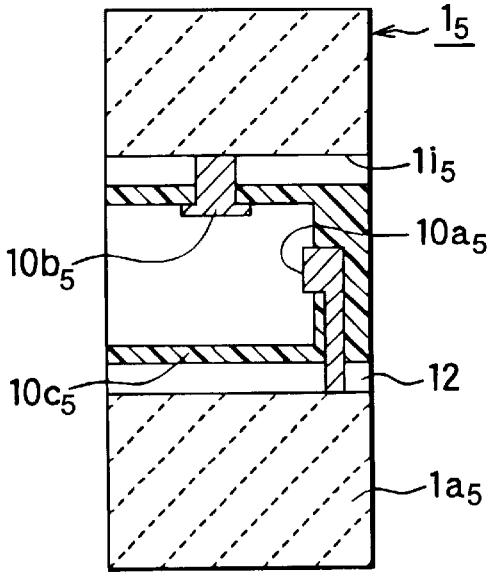
FIG. 8B is a cross-sectional view along line 8B—8B in FIG. 8A.

As shown in FIGS. 8A and SB, a through hole $\mathbf{1}i_5$ penetrates through the case $\mathbf{1}a_5$. Thus, a front side and a rear side of the lighting device $\mathbf{1}_5$ are connected by the through hole $\mathbf{1}i_5$. A diameter of the through hole $\mathbf{1}i_5$ is larger than an outer diameter of the connector housing $\mathbf{10}c_5$. The positive terminal $\mathbf{10}a_5$ and the negative terminal $\mathbf{10}b_5$ of the lighting device $\mathbf{1}_5$ protrude from an inner peripheral wall of the through hole $\mathbf{1}i_5$. The connector housing $\mathbf{10}c_5$ is supported by both the positive terminal $\mathbf{10}a_5$ and the negative terminal $\mathbf{10}b_5$.

In this way, a space (second space) 12 indicated with the shading lines in FIG. 8A is formed between the outer peripheral wall surface of the connector housing $\mathbf{10}c_5$ and the case $\mathbf{1}a_5$ of the lighting device $\mathbf{1}_5$. The outer peripheral wall surface of the connector housing $\mathbf{10}c_5$ is surrounded by the space 12.

According to this structure, even if the heat generated from the heated discharge lamp 5 is transmitted to the connector housing $\mathbf{10}c_5$, the heat is not easily transmitted from the connector housing $\mathbf{10}c_5$ to the lighting device $\mathbf{1}_5$ due to the space 12 arranged around the outer peripheral wall surface of the connector housing 10*c*5. Thus, the advantages similar to those discussed with reference to the third embodiment can be achieved.

In the present embodiment, the structure on the inner peripheral wall surface of the connector housing $\mathbf{10}c_5$ is not discussed. However, the space 11 can be provided between the inner peripheral wall surface of the connector housing 10*c* (or $\mathbf{10}c_4$) and the discharge lamp 5 as discussed with reference to the third and fourth embodiments. The heat insulation can be further enhanced to reduce the thermal stress on the lighting device 1. Thus, there is provided the lighting device 1 that can more effectively avoid the damage induced by the thermal stress.

(Other Embodiments)

In each one of the first to fifth embodiments, the lighting device 1 (or lighting devices $\mathbf{1}_3$, $\mathbf{1}_4$ or $\mathbf{1}_5$) is accommodated within the headlight unit 2. However, the lighting device 1 (or lighting devices $\mathbf{1}_3$, $\mathbf{1}_4$ or $\mathbf{1}_5$) can be arranged outside of the headlight unit 2. In this case, the discharge lamp 5 is connected to the connector 1*b* of the lighting device 1 (or lighting devices $\mathbf{1}_3$, $\mathbf{1}_4$ or $\mathbf{1}_5$) through the hole that penetrates the housing 4. Here, the advantages similar to those described with reference to each one of the above embodiments can be achieved.

Furthermore, in the first and second embodiments, the retaining portions 6*b*–6*e* of the reflector 6, the securing portions 8*b* and 8*c* of the holder 8 (or portions $\mathbf{8}b_2$ and $\mathbf{8}c_2$ of holder $\mathbf{8}_2$) and the securing portions 1*c* and 1*d* of the case 1*a* are arranged on the left side and right side of the discharge lamp 5. This arrangement is made to further enhance the described advantages. The positions and the number of the retaining portions and the securing portions are not limited to those described above and can be changed to any positions and any numbers.

Furthermore, in the first and second embodiments, because of the provision of the holder 8 (or holder $\mathbf{8}_2$), the member for holding the discharge lamp 5 is separated from the member for securing the lighting device 1 to the headlight unit 2 or to the component in the headlight unit 2. This separation can be achieved without the holder 8 (or holder $\mathbf{8}_2$).

For example, the shade 9 can have an arrangement similar to the spring 8*d* (or spring $\mathbf{8}d_2$) to retain the discharge lamp 5, and the lighting device 1 can be secured to the reflector 6. In this instance, the shade 9 corresponds to the member for holding the discharge lamp 5.

Instead of this, the reflector 6 can have an arrangement similar to the spring 8*d* (or spring $\mathbf{8}d_2$) to retain the discharge lamp 5, and the lighting device 1 can be secured to the shade 9. In this instance, the reflector 6 corresponds to the member for holding the discharge lamp 5, and the shade 9 corresponds to the component in the headlight unit 2 to which the lighting device 1 is secured.

In this way, the member for holding the discharge lamp 5 is separated from the member for securing the lighting device 1 to the headlight unit 2 or to the component in the headlight unit 2. As a result, the thermal stress on the lighting device 1 is reduced, and thus the advantages similar to those described above can be achieved.

In the first and second embodiments, the securing portions 1*c* and 1*d* provided on the case 1*a* are used as a specific example of the member for securing the lighting device 1 to the headlight unit 2 or to the component in the headlight unit 2. This member, i.e., the securing portions 1*c* and 1*d* can be separated from the case 1*a*.

In the third embodiment, the plurality of protrusions 10*d* are provided. However, the space between the discharge lamp 5 and the connector housing 10*c* can be formed even with one protrusion.

However, the protrusions 10*d* are more preferred to effectively position the discharge lamp 5 in place. For instance, three protrusions can be provided along the inner peripheral wall surface of the connector housing at equal intervals to engage with the outer peripheral wall surface of the discharge lamp 5. In this way, the discharge lamp 5 can be held by the three protrusions. Instead of the three protrusions, two protrusions and one negative terminal can be arranged along the inner peripheral wall surface of the connector housing at equal intervals. In this instance, the discharge lamp 5 can be supported by the two protrusions and the one negative terminal.

Additional advantages and modifications will readily occur to those skilled in the art. The invention in its broader terms is therefore, not limited to the specific details, representative apparatus, and illustrative examples shown and described.

What is claimed is:

1. A mounting structure for mounting a discharge lamp lighting device, said mounting structure being arranged to directly connect a discharge lamp provided in a headlight unit to a connector provided in said discharge lamp lighting device, wherein said headlight unit includes a reflector, said mounting structure comprising:

a holder for holding said discharge lamp, wherein said holder includes a holder securing portion directly connected to said reflector and is secured to said reflector via said holder securing portion, and said discharge lamp is secured to said reflector via said holder; and a securing member directly connected to said reflector for securing said discharge lamp lighting device to said reflector, wherein said holder and said securing member are separated from each other, and said discharge lamp lighting device is secured to said reflector via said securing member.

2. A mounting structure for mounting a discharge lamp lighting device according to claim 1, wherein:

said holder includes a holder opening for receiving said discharge lamp; and said holder securing portion is offset from an area above said holder opening.

3. A mounting structure for mounting a discharge lamp lighting device according to claim 1, wherein:

said securing member is offset from an area above said connector.

4. A mounting structure for mounting a discharge lamp lighting device according to claim 1, wherein:

said reflector has a plurality of retaining portions to which said holder securing portion and said securing member are secured; and wherein each one of said retaining portions to which said holder securing portion is secured differs from each one of said retaining portions to which said securing member is secured.

5. A mounting structure for mounting a discharge lamp lighting device according to claim 1, wherein:

said reflector is made of a resin material.

6. A mounting structure for mounting a discharge lamp lighting device according to claim 1, wherein:

said securing member is secured to said reflector while said holder securing portion is interposed between said securing member and said reflector; and said holder has a slit between a region where said discharge lamp is held and said holder securing portion that is located between said securing member and said reflector.

7. A mounting structure for mounting a discharge lamp lighting device according to claim 1, wherein:

said discharge lamp lighting device is provided in said headlight unit.

8. A discharge lamp lighting device comprising:

a case for accommodating an internal circuit, said case including a connector to which a discharge lamp is directly connected, wherein said connector includes a cup shaped connector housing that receives said discharge lamp, and wherein a first space is formed between an inner peripheral wall surface of said connector housing and an outer peripheral wall surface of said discharge lamp.

9. A discharge lamp lighting device according to claim 8, wherein:

said inner peripheral wall surface of said connector housing has a plurality of terminals to which said discharge lamp is connected; and said plurality of terminals radially extend toward a center axis of said connector housing, said first space being formed by said plurality of terminals.

10. A discharge lamp lighting device according to claim 8, wherein:

said case has a window; and said discharge lamp is received in said connector housing through said window.

11. A discharge lamp lighting device according to claim 8, wherein:

said case has a through hole;

said connector housing is received in said through hole;

an inner diameter of said through hole is larger than an outer diameter of said connector housing; and a second space is formed along an outer peripheral surface of said connector housing.

12. A discharge lamp lighting device according to claim 8, wherein:

said inner peripheral wall surface of said connector housing has a plurality of protrusions that radially extend toward a center axis of said connector housing; and said first space is formed by said plurality of protrusions.

13. A discharge lamp lighting device according to claim 12, wherein:

said inner peripheral wall surface of said connector housing has a terminal that is connected to said discharge lamp; and said first space is formed between said plurality of protrusions and said terminal.

14. A discharge lamp lighting device according to claim 8, wherein:

said inner wall surface of said connector housing has a terminal that is connected to said discharge lamp, wherein said first space is formed by said terminal.

15. A discharge lamp lighting device according to claim 14, wherein:

said terminal includes a plurality of terminal portions arranged along said inner wall surface of said connector housing.

16. A discharge lamp lighting device according to claim 8, wherein:

said inner wall surface of said connector housing has a protrusion that forms said first space.

17. A discharge lamp lighting device according to claim 16, wherein:

said inner wall surface of said connector housing has a terminal that is connected to said discharge lamp; and said first space is formed between said protrusion and said terminal.

18. A discharge lamp lighting device according to claim 16, wherein:

said protrusion includes a plurality of protrusion portions arranged along said inner wall surface of said connector housing.

19. A mounting structure for mounting a discharge lamp lighting device, said mounting structure being arranged to directly connect a discharge lamp provided in a headlight unit to a connector provided in said discharge lamp lighting device, said mounting structure comprising:

a holder for holding said discharge lamp, wherein said discharge lamp is secured to one of said headlight unit and a component in said headlight unit via said holder; and a securing member for securing said discharge lamp lighting device to said headlight unit or to a component in said headlight unit, wherein said holder and said securing member are separated from each other, wherein:

said holder includes a holder securing portion for securing said discharge lamp to said one of said headlight unit and said component in said headlight unit;

said headlight unit has a reflector therein;

said discharge lamp lighting device is secured to said reflector via said securing member;

said holder is secured to said reflector via said holder securing portion;

said reflector has a plurality of retaining portions to which said holder securing portion and said securing member are secured;

wherein each one of said retaining portions to which said holder securing portion is secured differs from each one of said retaining portions to which said securing member is secured;

said reflector includes a reflector opening for receiving said discharge lamp, wherein two of said retaining portions of said reflector are vertically aligned and are arranged on a left side of said reflector opening, and other two of said retaining portions of said reflector are vertically aligned and are arranged on a right side of said reflector opening; and among said four retaining portions of said reflector, one diagonal pair of said retaining portions are secured with said holder securing portion, other diagonal pair of said retaining portions are secured with said securing member.

20. A discharge lamp lighting device comprising:

a case for accommodating an internal circuit, said case including a connector to which a discharge lamp is directly connected, wherein said connector includes a connector housing that receives said discharge lamp, wherein a space is formed between an inner wall surface of said connector housing and an outer wall surface of said discharge lamp, wherein said inner wall surface of said connector housing has a terminal that is connected to said discharge lamp, wherein said inner wall surface of said connector housing also has a protrusion that forms said space, and wherein said space is formed between said protrusion and said terminal.

21. A discharge lamp lighting device comprising:

a case for accommodating an internal circuit, said case including a connector to which a discharge lamp is directly connected, wherein said connector includes a cup shaped connector housing that receives said discharge lamp, wherein said case has a through hole that receives said connector housing, wherein an inner diameter of said through hole is larger than an outer diameter of said connector housing, and wherein a space is formed along an outer peripheral surface of said connector housing.

* * * * *